US010926535B2

(12) United States Patent
Linn et al.

(10) Patent No.: US 10,926,535 B2
(45) Date of Patent: Feb. 23, 2021

(54) VOLTAGE REGULATOR FOR LOW SIDE SWITCH GATE CONTROL

(71) Applicant: HEWLETT-PACKARD DEVELOPMENT COMPANY, L.P., Spring, TX (US)

(72) Inventors: Scott A Linn, Corvallis, OR (US); Vincent C Korthuis, Corvallis, OR (US); James M Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/618,940

(22) PCT Filed: Jul. 12, 2017

(86) PCT No.: PCT/US2017/041785

§ 371 (c)(1),
(2) Date: Dec. 3, 2019

(87) PCT Pub. No.: WO2019/013788

PCT Pub. Date: Jan. 17, 2019

(65) Prior Publication Data

US 2020/0139700 A1 May 7, 2020

(51) Int. Cl.
*B41J 2/045* (2006.01)

(52) U.S. Cl.
CPC ..... *B41J 2/0455* (2013.01); *B41J 2/0458* (2013.01); *B41J 2/04541* (2013.01); *B41J 2/04548* (2013.01)

(58) Field of Classification Search
CPC .. B41J 2/0455; B41J 2/04541; B41J 2/04548; B41J 2/0458; B41J 2/04543
See application file for complete search history.

(56) References Cited

U.S. PATENT DOCUMENTS 6,302,504 B1 * 10/2001 Imanaka et al. ..... B41J 2/0455 347/9
6,439,678 B1 8/2002 Norton
7,513,588 B2 4/2009 Huang
8,757,778 B2 6/2014 Fricke et al.
9,505,211 B2 11/2016 Fujii et al.
(Continued)

OTHER PUBLICATIONS

Wassink,et al., Enabling Higher Jet Frequencies for an Inkjet Print-head Using Iterative Learning Control, Aug. 28-31, 2005. 2005 IEEE Conference on Control Applications.

*Primary Examiner* — Julian D Huffman
(74) *Attorney, Agent, or Firm* — Rathe Lindenbaum LLP

(57) ABSTRACT

A fluidic die may include a fluid actuator comprising an electrical resistor, a power node to supply electrical current to the resistor to drive the fluid actuator, a low side switch transistor connected to a ground node and having a gate to control the flow of electrical current through the resistor, a voltage regulator to receive electrical power from the power node and to output a predetermined voltage and a level shifter to control to output a low side switch transistor gate drive voltage using the predetermined voltage and based upon control signals to control the gate to control fluid displacement by the fluid actuator. The predetermined voltage is greater than a voltage of the control signals and is independent of a resistance of the ground node.

20 Claims, 4 Drawing Sheets

(56) References Cited

U.S. PATENT DOCUMENTS

| | | | |
|---|---|---|---|
| 2002/0070989 | A1 | 6/2002 | Yang |
| 2005/0110819 | A1 | 5/2005 | Kim |
| 2009/0040277 | A1 | 2/2009 | Han et al. |
| 2009/0174753 | A1 | 7/2009 | Kurokawa |
| 2009/0237433 | A1 | 9/2009 | Silverbrook |

* cited by examiner

VOLTAGE REGULATOR FOR LOW SIDE SWITCH GATE CONTROL

BACKGROUND

Fluidic dies selectively displace fluid within or from the fluidic die. Such fluidic dies may include fluid actuators that are selectively actuated using low side switch transistors. A gate of each of the low side switch transistors may be controlled to control the displacement of fluid. Some low side switches may also be combined with high side switches to selectively actuate individual fluid actuators. One example of fluid actuators of such a fluidic die are fluid actuators found on a print head of a printing system.

Figure 1:
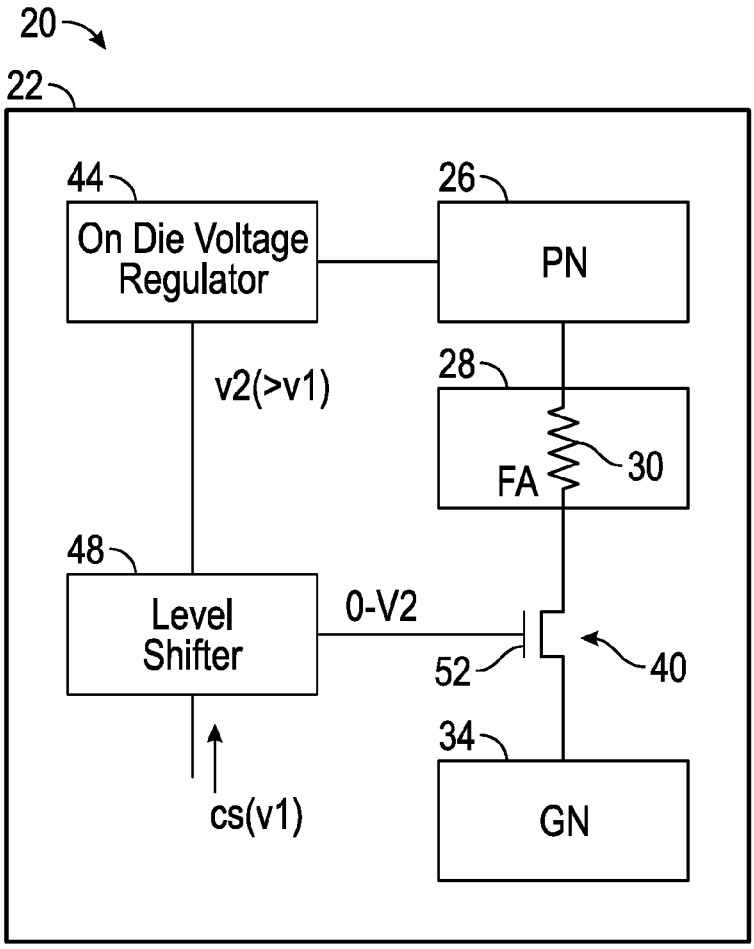
FIG. 1 is a schematic diagram illustrating portions of an example fluidic die.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Many fluidic dies that utilize low side switches to control actuation of fluid actuators directly control the gates of the low side switch transistors with logic control signals at a lower voltage from a digital logic voltage supply, such as from a Vdd power supply, which is at a voltage lower than a power node voltage As the number of fluid actuators that are actuated/fired at any one moment increases, the electrical resistance of the ground node increases, causing the low side switch to become more resistive when in the on state. This may result in inadequate current flow through the low side switch, detrimentally impacting the displacement of fluid by the low current through the resistors of the fluid actuators.

Disclosed herein are example fluidic dies and methods that utilize the existing power node that drives the fluid actuator, an on-die voltage regulator and a level shifter to provide a low side switch drive voltage that is greater than the voltage of the digital control signals and that is constant and independent of a resistance of the ground node. The larger low side switch drive voltage may facilitate a reduction in the size of the low side switch transistor and may allow a greater number of fluid actuators to be concurrently actuated. Reducing the size of the low side switch transistor conserves valuable space on the fluidic die and reduces cost. Because the low side switch drive voltage is predetermined and constant, the fluidic die may omit ground node sensing circuitry or ground follower circuitry, further conserving valuable space on the fluidic die and reducing cost. For example, eliminating or reducing ground node sensing circuitry or ground follower circuitry may conserve valuable space adjacent to and between columns of fluid actuators on the fluidic die.

In example fluidic dies, the array of fluid actuators may be arranged in respective sets of fluid actuators, where each such set of fluid actuators may be referred to as a "primitive" or a "firing primitive." A primitive generally comprises a group of fluid actuators that each have a unique actuation address. In some examples, electrical and fluidic constraints of a fluidic die may limit which fluid actuators of each primitive may be actuated concurrently for a given actuation event. Therefore, primitives facilitate addressing and subsequent actuation of fluid ejector subsets that may be concurrently actuated for a given actuation event. A number of fluid ejectors corresponding to a respective primitive may be referred to as a size of the primitive.

To illustrate by way of example, if a fluidic die comprises four primitives, where each respective primitive comprises eight respective fluid actuators (each eight fluid actuator group having an address 0 to 7), and electrical and fluidic constraints limit actuation to one fluid actuator per primitive, a total of four fluid actuators (one from each primitive) may be concurrently actuated for a given actuation event. For example, for a first actuation event, the respective fluid actuator of each primitive having an address of 0 may be actuated. For a second actuation event, the respective fluid actuator of each primitive having an address of 1 may be actuated. As will be appreciated, the example is provided merely for illustration purposes. Fluidic dies contemplated herein may comprise more or less fluid actuators per primitive and more or less primitives per die.

In some examples, a fluid actuator may be disposed in a nozzle, where the nozzle may comprise a fluid chamber and a nozzle orifice in addition to the fluid actuator. The fluid actuator may be actuated such that displacement of fluid in the fluid chamber may cause ejection of a fluid drop via the nozzle orifice. Accordingly, a fluid actuator disposed in a nozzle may be referred to as a fluid ejector.

Some example fluidic dies comprise microfluidic channels. Microfluidic channels may be formed by performing etching, microfabrication (e.g., photolithography), micromachining processes, or any combination thereof in a substrate of the fluidic die. Some example substrates may include silicon based substrates, glass based substrates, gallium arsenide based substrates, and/or other such suitable types of substrates for microfabricated devices and structures. Accordingly, microfluidic channels, chambers, orifices, and/or other such features may be defined by surfaces fabricated in the substrate of a fluidic die. Furthermore, as used herein a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Example fluidic dies described herein may comprise microfluidic channels in which fluidic actuators may be disposed. In such implementations, actuation of a fluid actuator disposed in a microfluidic channel may generate fluid displacement in the microfluidic channel. Accordingly, a fluid actuator disposed in a microfluidic channel may be referred to as a fluid pump.

The example fluidic dies disclosed herein may comprise fluid ejection dies that facilitate the selective ejection of fluid. In one implementation, the example fluidic dies may comprise printheads for a printing device. Such a printing device may print two-dimensional images on print media, wherein the fluid ejection die ejects fluid contained in a reservoir and were in the fluid may comprise ink, toner, varnish, gloss, a fixing agent or the like. Such a printing device may print three-dimensional objects, such as with a 3-D printer or additive manufacturing device. In some implementations, the fluid ejection dies may form part of a print cartridge. In yet other implementations, a plurality of such fluid ejection dies may form a page-wide device that is to span and print across a width of a print medium.

Disclosed herein are example fluidic dies that may comprise a fluid actuator comprising an electrical resistor, a power node to supply electrical current to the resistor to drive the fluid actuator, a low side switch transistor connected to a ground node and having a gate to control the flow of electrical current through the resistor, an on die or off die voltage regulator to receive electrical power from the power node and to output a predetermined voltage and a level shifter to control to output a low side switch transistor gate drive voltage using the predetermined voltage and based upon control signals to control the gate to control fluid displacement by the fluid actuator. The predetermined voltage is greater than a voltage of the control signals and is independent of a voltage rise of the ground node.

Disclosed herein is an example fluidic die that may comprise a substrate, a power node on the substrate, a ground node on the substrate and fluid actuators supported by the substrate and grouped into primitives. Each fluid actuator may be selectively actuated using a low side switch transistor and at least one high side switch transistor. Each fluid actuator of each primitive may comprise a resistor having a first side and a second side. The high side switch transistor is electrically connected between the first side of each resistor of each fluid actuator and to the power node. A high side switch primitive level shifter on the substrate which is connected to the power node may generate a switch drive voltage for a gate of the first transistor based upon first control signals. Each low side switch transistors electrically connected between the second side of a respective resistor of the respective fluid actuator and the ground node. Second level shifters may generate a second switch drive voltage for controlling a gate of a respective low side switch transistors using a regulated predetermined voltage and based upon second control signals. A voltage regulator on the substrate may supply power at a regulated predetermined voltage to the second level shifters, wherein the predetermined voltage is greater than a voltage of the second control signals and is independent of a resistance of the ground node.

Disclosed herein is an example method that comprises providing electrical power having a regulated predetermined voltage with a voltage regulator of a fluidic die and generating a switch drive voltage using the electrical power having the regulated predetermined voltage and based upon control signals to bias a low side switch transistor connected between an electrical resistor of a fluid actuator and a ground node for low side switch gate control, wherein the predetermined voltage is greater than a voltage of the control signals and independent of a resistance of the ground node.

FIG. 1 is a schematic diagram illustrating portions of an example fluidic die 20. Fluidic die 20 may be provided as part of a fluid actuation system that selectively displaces fluid within or from fluidic die 20. In one implementation, fluidic die 20 may be provided as part of a printing system, whether printing on a two-dimensional print media or whether printing fluid upon a build material in an additive manufacturing system. In other implementations, fluidic die 20 may be provided as part of a fluidic actuation system that moves fluid samples between various stations on the fluidic die at which different processes are carried out on the fluid sample or wherein characteristics of the fluid sample are sensed for analysis. As will be described below, fluidic die 20 provides a higher low side switch drive voltage so as to provide enhanced control over the gate of a low side switch independent of the current resistance of the ground node.

Fluidic die 20 comprises substrate 22, power node 26, fluid actuator 28 comprising resistor 30, ground node 34, low side switch transistor 40 on die voltage regulator 44 and level shifter 48. Substrate 22 comprises a base or platform upon which the circuitry and components of fluidic die 22 are supported. Substrate 22 may be formed from material such as silicon, ceramics, glass, polymers or other materials.

Power node 26 comprises an electrically conductive trace or wire along which power, sometimes referred to as Vpp supply, is transmitted along fluidic die 20. Power node 26 supplies electrical power for driving fluid actuator 28. Power node 26 supplies electrical current for being directed across resistor 30. In one implementation, power node 26 supplies power having a voltage of generally between 28 and 35 V. In other implementation, power node 26 may supply power having other voltage levels.

Fluid actuator 28 comprise a device to displace fluid within or from fluidic die 20. Fluid actuator 28 utilizes resistor 30 to carry out such displacement. In one implementation, fluid actuator 28 forms a fluid pump, such as an inertial pump, that displaces fluid within an along a microfluidic channel of fluidic die 20. In another implementation, fluid actuator 28 forms a fluid ejector, wherein fluid actuator 28 is part of a nozzle, disposed within a firing chamber having a nozzle orifice, wherein actuation of fluid actuator 28 ejects fluid through the orifice. In one implementation, fluid actuator 28 comprises a thermal-resistive based fluid actuator, wherein electrical current flowing through resistor 30 generates a sufficient amount of heat to vaporize adjacent fluid creating a bubble that forcefully moves surrounding fluid. In another implementation, fluid actuator 20 may comprise a piezo-resistive based fluid actuator, wherein the transmission of the electrical current through resistor 30 causes the piezo actuator to change shape, moving a membrane to displace adjacent fluid.

Ground node 34 comprise an electrically conductive trace or wire on substrate 22 of fluidic die 20 providing an electrical ground for each of the fluid actuators 28 on die 20. Ground node 34 is at a voltage, sometimes referred to as Pgnd, that is nominally zero, but which may fluctuate depending upon the number of fluid actuators 28 being concurrently actuated at any point in time.

Low side switch transistor 40 is electrically connected between fluid actuator 28 and ground node 34. Low side switch transistor 40 has a gate 52 that controls the flow of electrical current from fluid actuator 28 to ground node 34 and thereby control the flow of electrical current through and across resistor 30. Fluidic die 20 facilitates enhanced control over gate 52 with higher low side switch gate drive voltage than with on die logic voltage.

On die voltage regulator 44 comprises a voltage regulator disposed on substrate 22 that is powered by power node 26. Voltage regulator 44 outputs a constant predetermined voltage V2 that is used by level shifter 48 to generate the low side switch gate drive voltage that controls gate 52 of transistor 40. The voltage V2 of the power output by voltage regulator 44 is less than the voltage of power node 26 but is greater than the voltage of logic control signals received by level shifter 48. The constant predetermined voltage V2 output by regulator 44 is independent of the electrical resistance or voltage of ground node 34. In other words, the voltage V2 does not fluctuate despite the fluctuation of the resistance in the voltage of ground node 34 as different numbers of fluid actuators 28 electrically connected to ground node 34 are concurrently fired or actuated.

In one implementation, on die voltage regulator 44 provides a plurality of distinct voltage levels from which the predetermined voltage level may be selected. In one implementation, voltage regulator 44 outputs power at a voltage of greater than 5 V. In one implementation, voltage regular 44 outputs power at a voltage selected from the options of 5.9 V, 6.5 V or 7 V, as selected by a user. In other implementations, voltage regulator 44 may output power at other voltage levels that are greater than the voltage of the control signals received by level shifter 48 but less than the voltage of power node 26.

Level shifter 48 comprises a device or circuitry that utilizes the power supplied by on die voltage regulator 44 to generate, based upon receive control signals CS at V1, the low side switch gate actuation voltage which pulls up gate 52 to the voltage V2. Level shifter 48 provides gate 52 with a low side switch drive voltage that is greater than the voltage of the digital control signals and that is constant and independent of a resistance of the ground node 34. The larger low side switch drive voltage V2 may facilitate a reduction in the size of the low side switch transistor 40 and may allow a greater number of fluid actuators 28 to be concurrently actuated. Reducing the size of the low side switch transistor 40 conserves valuable space on the fluidic die and reduces cost. Because the low side switch drive voltage V2 is predetermined and constant, the fluidic die 20 may omit ground node sensing circuitry or ground follower circuitry, further conserving valuable space on the fluidic die 20 in reducing cost.

Figure 2:
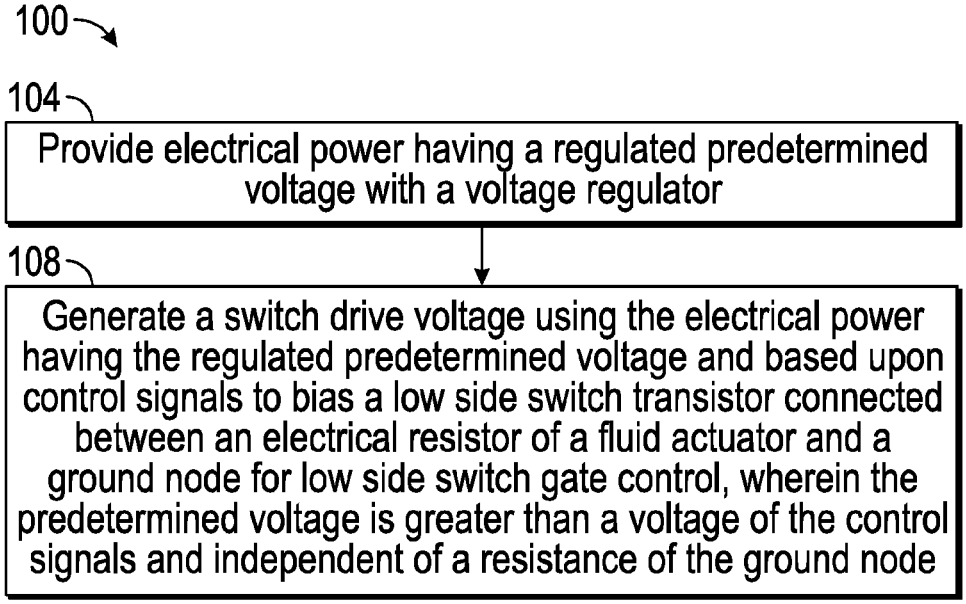
FIG. 2 is a flow diagram of an example method for controlling the gate of a low side switch transistor to control fluid displacement by a fluid actuator.

FIG. 2 is a flow diagram of an example method 100 for controlling the gate of a low side switch transistor to control fluid displacement by a fluid actuator. Method 100 facilitates the use of a higher low side switch gate actuation voltage to provide enhanced control over the actuation of fluid actuators 28. Although method 100 is described in the context of being carried out fluidic die 20, it should be appreciated that method 100 may be carried out with any of the other fluidic dies described herein as well as other similar fluidic dies.

As indicated by block 104, an on die voltage regulator on a fluidic die, such as regulator 44 on fluidic die 20, provides electrical power having a regulated predetermined voltage. The voltage is greater than the voltage of digital control signals received by level shifter 48 and less than the voltage of power node 26. The voltage provided by regulator 44 remains constant, independent of any resistances or voltage changes at ground node 34 as the number of fluid actuators on fluidic die 20 being fired at a moment in time change.

As indicated by block 108, level shifter 48 generates a low side switch drive voltage for the low side switch transistor 40 using the electrical power from on die voltage regulator 44 that has the regulated predetermined voltage. Level shifter 48 generates the switch drive voltage based upon control signals CS. The switch drive voltage biases the low side switch transistor 40 which is connected between the electrical resistor 30 of fluid actuator 28 and ground node 34 for low side switch gate control. The predetermined voltage is greater than a voltage of the control signals and independent of a resistance of the ground node 34.

Figure 3:
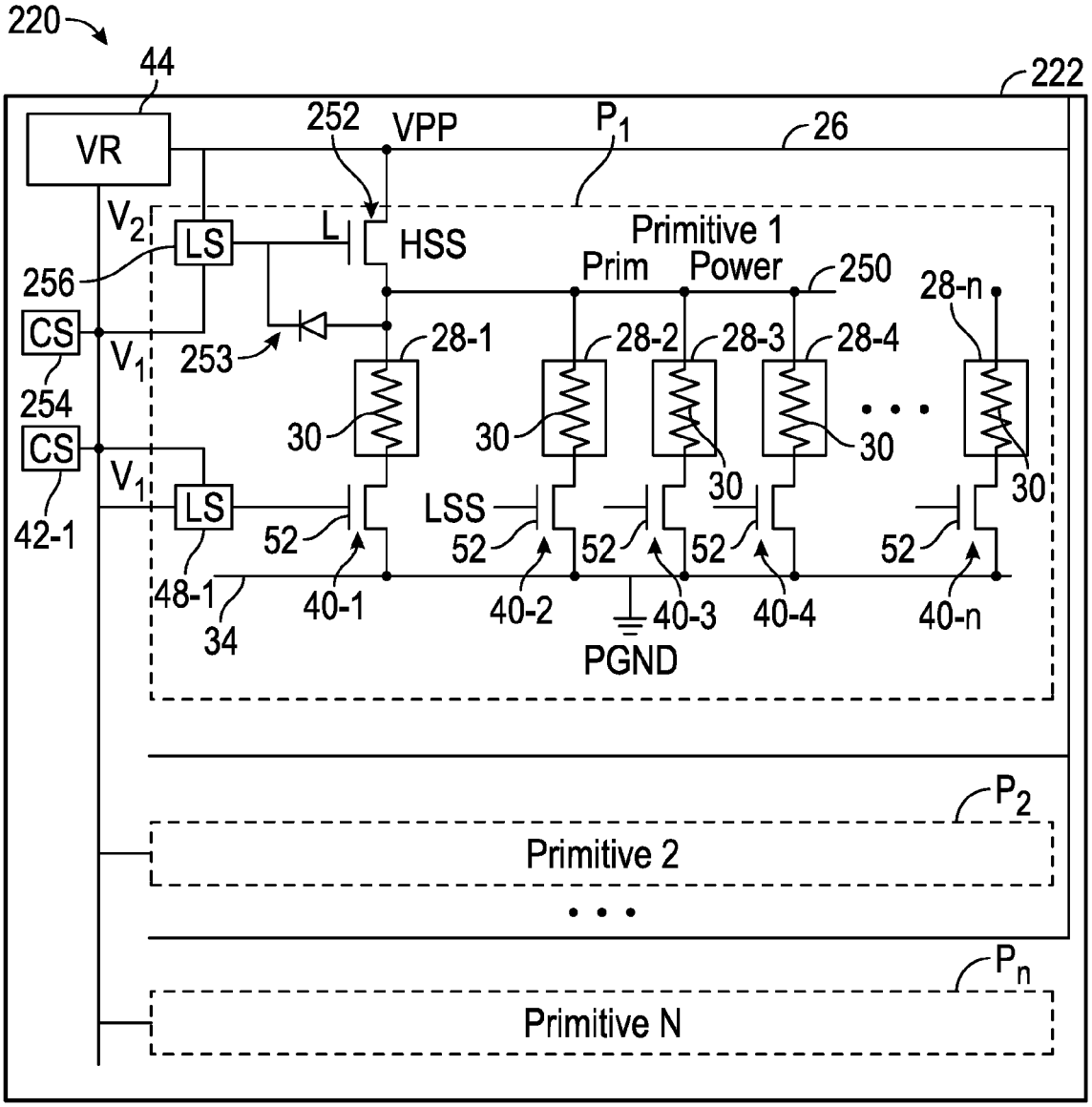
FIG. 3 is a schematic diagram illustrating portions of an example fluidic die.

FIG. 3 schematically illustrates portions of an example fluidic die 220. As with fluidic die 20, fluidic die 220 provides electrical power having a regulated predetermined voltage with a voltage regulator of a fluidic die and generates a low side switch drive voltage to bias the low side switch transistor connected between an electrical resistor of the fluid actuator and a ground node. The low side switch drive voltage is generated by level shifter using the electrical power from the on die voltage regulator and based upon received control signals. The predetermined voltage output by the on die regulator and utilized by the level shifter to generate the low side switch drive voltage is greater than a voltage of the digital control signals and independent of a resistance of the ground node.

Fluidic die 220 comprises substrate 222, power node 26, fluid actuators **28-1-28-*n* (collectively referred to as fluid actuators 28), ground node 34, low side switch transistors 40-1-40-*n* (collectively referred to as transistors 40), low side control signal sources 42-1-42-*n* (one of which is shown), on die voltage regulator 44, level shifters 48-1-48-*n* (one of which is shown), high side primitive power node 250, high side switch primitive transistor 252, clamp circuitry 253, high side primitive control signal source 254 and high side switch primitive level shifter 256. Substrate 222 is similar to substrate 22 and supports the remaining components of fluidic die 220. In one implementation, substrate 222 has formed therein microfluidic channels, wherein at least some of the fluid actuators 28 form inertial pumps to pump fluid through the microfluidic channels. In one implementation, substrate 222 is formed therein firing chambers having orifices, wherein at least some of fluid actuators 28** are arranged in the firing chambers to selectively eject fluid through the orifices.

Power node 26, fluid actuators 28, ground node 34, on die voltage regulator 44 and level shifters 48 are each individually described above with respect to fluidic die 20. Although a single level shifter 48-1 and a single corresponding low side control signal source 42-1 are illustrated, it should be appreciated that each low side switch 40-1 to **40-*n* has an associated level shifter and a corresponding low side control signal source, wherein each level shifter outputs a low side switch drive voltage for its corresponding low side switch 40 using power from voltage regulator 44 and based upon control signals received from its associated control signal source 42**.

As shown by FIG. 3, fluid actuators 28 and their individual associated circuitry are grouped into a primitive P1. As further schematically shown by FIG. 3, fluidic die 220 may comprise multiple such primitives, P2-Pn, wherein each of such primitives is similar to the primitive P1 illustrated in detail in FIG. 3. Each of such primitives is electrically connected between the power node 26 and ground node 34. Each of such primitives is serviced by the single voltage regulator 44 which supplies a predetermined regulated voltage to each of the level shifters 48 of each of the actuators 28 of each primitive. Each of the fluid actuators 28 of a primitive are, partly enabled, by primitive power node 250, high side primitive switch transistor 252 and high side primitive level shifter 256.

Primitive power node 250 comprises an electrically conductive trace or wire on substrate 222 that extends across and is electrically connected to the high side (the side of each of resistor 30 opposite to the ground node) of each of the resistors 30 of fluid actuators 28 of primitive P1. High side switch primitive transistor 252 is electrically connected between the power node 26 and primitive power node 250. Transistor 252 has a gate 260 which controls the flow of power from power node 26 to primitive power node 250.

Clamp circuitry 253 comprise circuitry that prevents over biasing or overvoltage related damage to transistor 252. In the example illustrated, clamp circuitry 253 comprises a diode. In other implementations, clamp circuitry 253 may be formed by other electrical components or may be omitted. In some implementations, such protection may also be provided by circuits other than a clamp, such as a resistor designed to blow above certain currents, or an analog sense circuit to detect shorts and shutdown firing and the like.

Primitive control signal source 254 comprises a source of control signals to enable each of the fluid actuators 28 of primitive P1. Primitive control signal source 254 may comprise an electrically conductive pad that receives control signals from an off-die source.

High side level shifter 256 comprises a device or circuitry that generates a high side switch drive voltage for the high side switch transistor 252 using the electrical power from power node 26 and based upon control signals from primitive control signal source 254. An individual fluid actuator 28 may be actuated or fired in response to (1) the primitive to which the fluid actuator belongs being enabled by the output of a high side switch drive voltage by the primitive level shifter 256 and (2) the individual fluid actuator 28 being enabled by the output of the low side switch drive voltage by the level shifter 48 associated with the individual fluid actuator 28.

In one implementation, each of the control signals V1 output by control signal sources 42 and 254 are at a voltage of less than 5 V. Power node 26 is that a voltage of generally 28-35 V. Voltage regulator 44 outputs power at predetermined constant voltage V2 that is greater than V1, but less than the voltage at power node 26. As described above, in one implementation, on die voltage regulator 44 provides a plurality of distinct voltage levels from which the predetermined voltage level may be selected. In one implementation, voltage regulator 44 outputs power at a voltage of greater than 5 V. In one implementation, voltage regular 44 outputs power at a voltage selected from the options of 5.9 V, 6.5 V or 7 V, as selected by a user. In other implementations, what is regulator 44 may output power at other voltage levels that are greater than the voltage of the control signals received by level shifter 48 but less than the voltage of power node 26.

Figure 4:
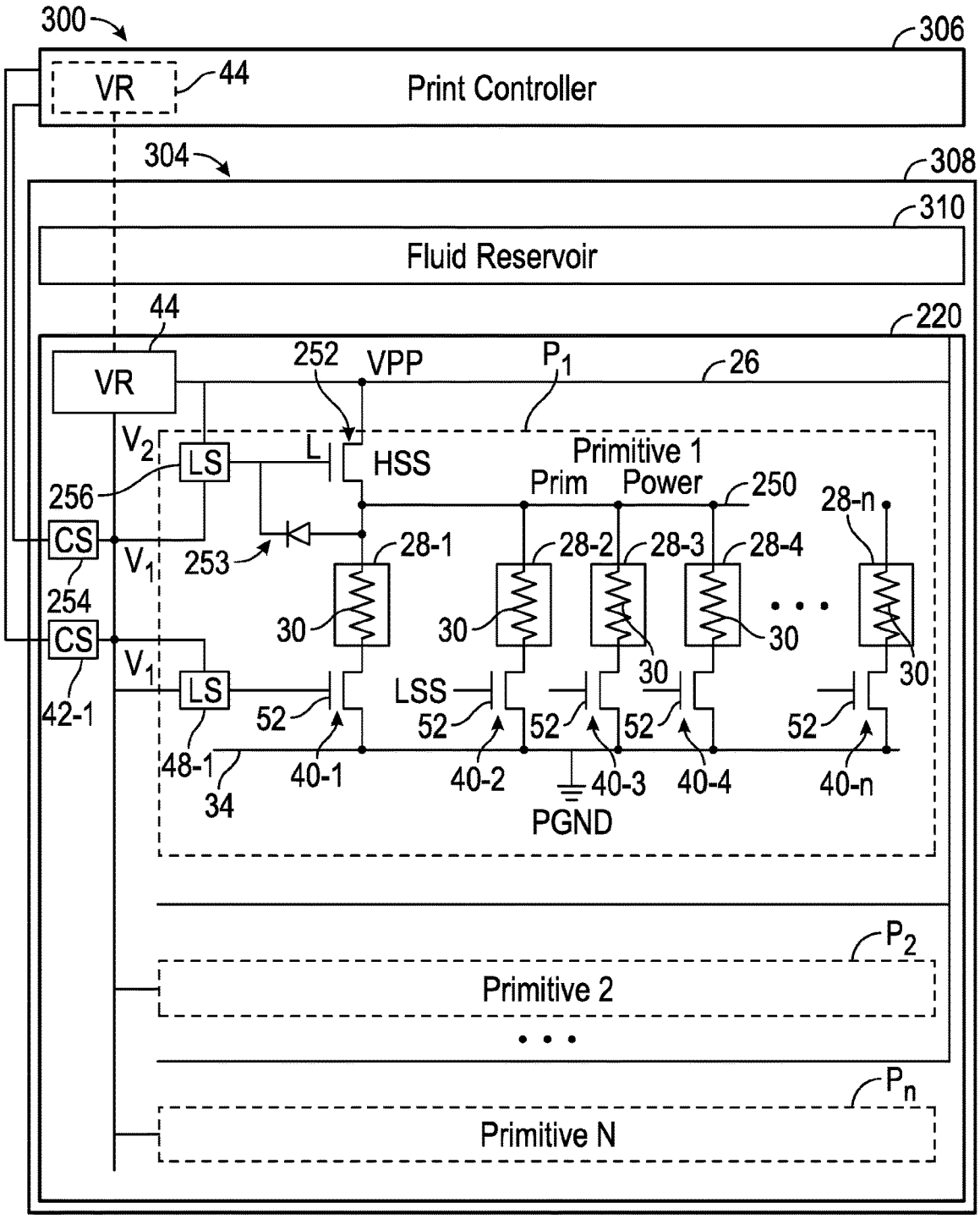
FIG. 4 is a schematic diagram illustrating portions of an example fluid ejection system having an example fluid ejection device.

FIG. 4 is a schematic diagram illustrating portions of an example fluid ejection system 300. System 300 is to selectively eject fluid. System 300 comprises fluid ejection device 304 and print controller 306. Fluid ejection device 304 carries out the ejection of fluid in response to control signals from print controller 306. Fluid ejection device 304 comprises housing 308, fluid reservoir 310 and fluidic die 220 which forms a fluid ejection die having nozzles 322 (shown in FIG. 5).

Housing 308 comprises an enclosure, frame or other structure supporting fluidic die 220 and fluid reservoir 310. In some implementations, housing 308 may additionally enclose and support print controller 306.

Fluid reservoir 310 comprises an internal volume formed within the body of housing 308 for containing a fluid to be ejected by fluid actuators 28 on fluidic die 220. Fluid reservoir 310 is fluidically connected to firing chambers having orifices thought to deliver fluid to the firing chambers, wherein fluid actuators 28, forming fluid ejectors, eject fluid through such orifices. In one implementation, fluid reservoir 310 supplies such fluids to fluid slots along the primitives P, and the fluid slots supply fluid to the firing chambers associated with each of the fluid actuators 28.

Print controller 306 comprises a processing unit and associated non-transitory memory containing instructions for the operation of fluid ejection device 304. Print controller 306, following such instructions, outputs control signals 254 and 42 which, as described above, control the actuation of fluid actuators 28 to selectively eject fluid. In the example illustrated, print controller 306 is located remote from fluidic die 220 and remote from housing 308. In other implementations, print controller 306 may be located separate from fluidic die 220, but within housing 308. In other implementations, controller 306 may be located on fluidic die 220. As further shown by broken lines in FIG. 5, in some implementations, voltage regulator 44 may be located off die, off fluidic die 220. In one implementation, voltage regular 44 may be provided as part of print controller 306 separate from fluid ejection device 304.

Figure 5:
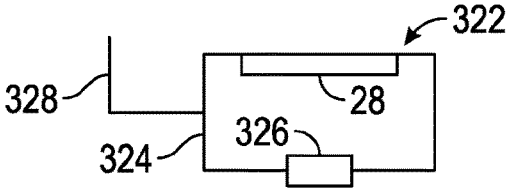
FIG. 5 is a schematic diagram illustrating an example nozzle of a fluidic die of the fluid ejection device of FIG. 4.

FIG. 5 schematically illustrates portions of fluidic die 220 forming a fluid ejection die that is part of fluid ejection device 304. FIG. 5 illustrates an individual nozzle 322 of fluidic die 220. In one implementation, each of fluid actuators 28 forms a fluid ejector for a corresponding nozzle 322. As shown by FIG. 5, each nozzle 322 comprises a firing chamber 324 having an orifice 326. The fluid actuator 28 associated with the particular nozzle 322 is situated in or adjacent to firing chamber 324 such that upon being actuated, ejects fluid within firing chamber 324 through orifice 326. In one implementation, fluid actuator 28 comprise a thermal resistive element that, when conducting current, generates a sufficient amount of heat to vaporize liquid within firing chamber 324 so as to displace and expel fluid within firing chamber 324 through orifice 326. Firing chamber 324 is filled and replenished with fluid to be ejected through fluid supply passage 328 (schematically shown) which is fluidly connected to fluid reservoir 310.

In one implementation, fluid ejection device 304 may comprise a print cartridge. Each of the fluid actuators 28 on fluidic die 220 are supplied with ink or other printing fluid from a self-contained fluid reservoir 310. In yet another implementation, fluid reservoir 310 may be replenished with ink are fluid from a fluid supply separate from the print cartridge formed by fluid ejection device 304. In such an implementation, fluid reservoir 310 may comprise ink, toner, varnish, gloss, fixing agents and the like. In some implementations, fluid ejection die 220 with its nozzles 322 may form a printhead.

Figure 6:
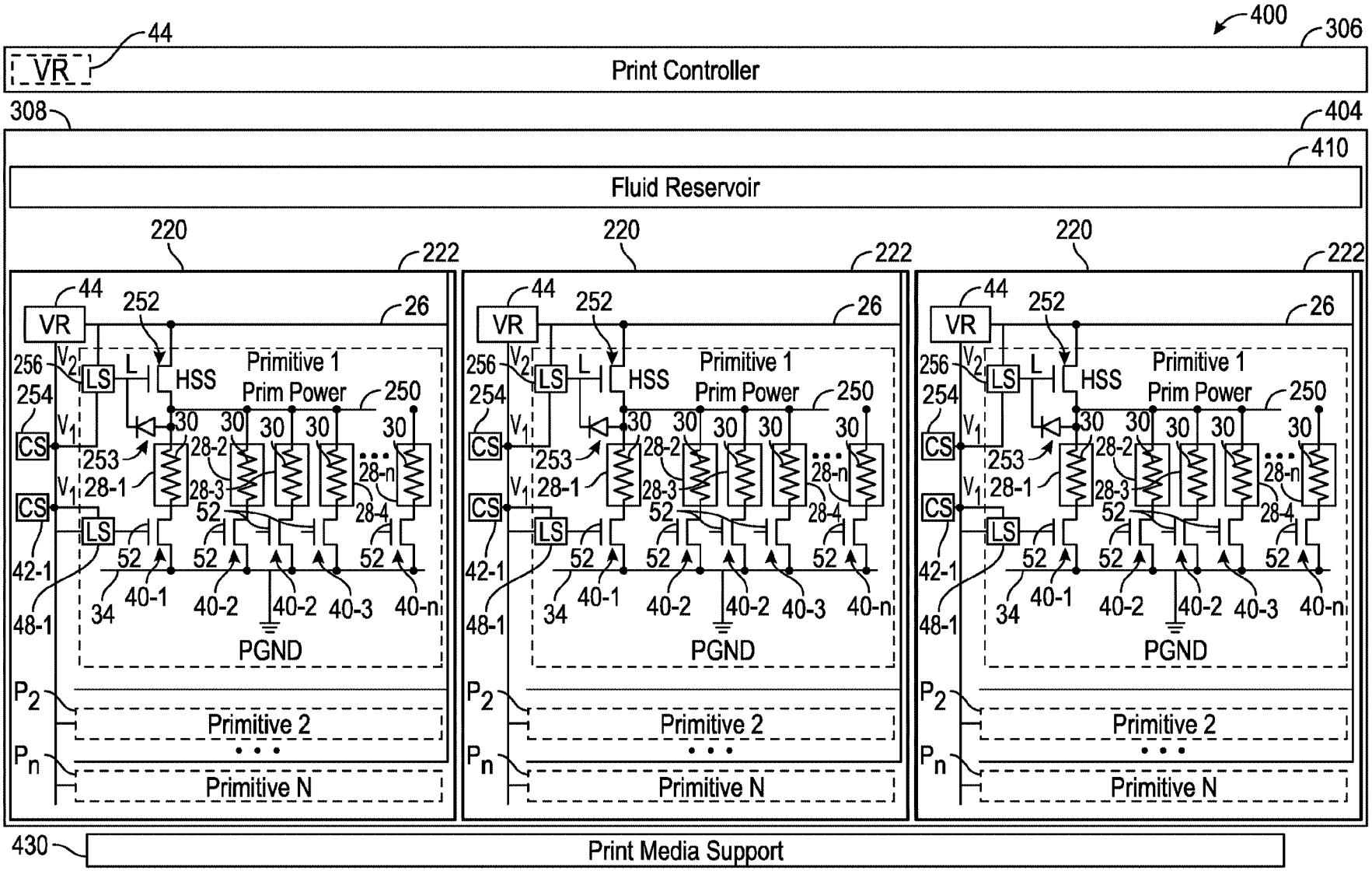
FIG. 6 is a schematic diagram illustrating portions of an example fluid ejection system having an example fluid ejection device.

FIG. 6 schematically illustrates portions of an example fluid ejection system 400. Fluid ejection system 400 is similar to fluid ejection system 300 except that fluid ejection system 400 comprises fluid ejection device 404 which comprises a plurality of fluidic dies 220 supported by housing 308. Fluidic die 220 forms fluid ejection dies having nozzles 322 (described above with respect to FIG. 5). In one implementation, fluid ejection device 404 comprises a sufficient number of fluidic dies 220 so as to span and completely extend across opposite print media support 430 which positions print media, such as sheets of paper, opposite to the fluid ejection device 404. In such an implementation, fluid ejection device 404 may comprise what may be referred to as a page-wide print bar or page-wide fluid ejection device. In some implementations, fluid ejection device 404 may comprise a plurality of fluid reservoirs 410 which supplied different types of fluid to the different fluidic dies. As described above, each of fluidic dies 220 may have a nozzle 322 (shown in FIG. 5) associated with each of fluid actuators 28. In some implementations, such putting die 220 may comprise additional fluid actuators 28 for circulating fluid into and across the firing chambers 324 of each of nozzles 322.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluidic die comprising:

a fluid actuator comprising an electrical resistor;

a power node to supply electrical current to the electrical resistor to drive the fluid actuator;

a low side switch transistor connected to a ground node and having a gate to control the flow of electrical current through the electrical resistor;

a voltage regulator to receive electrical power from the power node and to output a predetermined voltage; and a level shifter to output a low side switch transistor gate drive voltage using the predetermined voltage and based upon control signals to control the gate to control fluid displacement by the fluid actuator, the predetermined voltage being greater than a voltage of the control signals;

a high side transistor connected to the power node and having a gate to control the flow of electrical current to the resistor; and a second level shifter to output a high side switch transistor gate drive voltage based upon second control signals.

2. The fluidic die of claim 1, wherein the second level shifter is connected to the power node.

3. The fluidic die of claim 1, wherein the voltage of the control signal is less than or equal to 6 V.

4. The fluidic die of claim 1, wherein the regulated predetermined voltage of the power output by the voltage regulator is to remain constant independent of a number of fluid actuators being actuated at any time.

5. The fluidic die of claim 1, wherein each fluid actuator comprises a thermal resistive-based fluid actuator.

6. The fluidic die of claim 1, further comprising a firing chamber having an orifice, wherein the fluid actuator is located to selectively eject fluid within the firing chamber through the orifice.

7. The fluidic die of claim 1 further comprising a substrate, wherein the fluid actuator, the power node, the low side switch transistor, the high side switch transistor, the level shifter, and the second level shifter are supported by the substrate.

8. The fluidic die of claim 7, wherein the voltage regulator is supported by the substrate.

9. A fluid ejection system comprising a fluidic die, the fluidic die comprising:

a substrate;

a power node on the substrate;

a ground node on the substrate;

fluid actuators supported by the substrate and grouped into primitives, each fluid actuator of each primitive comprising a resistor having a first side and a second side;

a high side switch transistor electrically connected between the first side of each resistor of each fluid actuator and to the power node;

a level shifter on the substrate and connected to the power node to generate a switch drive voltage for a gate of the high side switch transistor based upon first control signals;

low side switch transistors, each of the low side switch transistors electrically connected between the second side of a respective resistor of each of the fluid actuators and the ground node;

second level shifters, each of the second level shifters to generate a second switch drive voltage for controlling a gate of a respective one of the low side switch transistors using a regulated predetermined voltage and based upon second control signals; and a voltage regulator on the substrate to supply power at a regulated predetermined voltage to the second level shifters, the predetermined voltage being greater than a voltage of the second control signals.

10. The fluid ejection system of claim 9, wherein the voltage of the control signal is less than or equal to 6 V.

11. The fluid ejection system of claim 9, wherein the predetermined voltage of the power output by the voltage regulator is to remain constant independent of a number of the fluid actuators being actuated at any time.

12. The fluid ejection system of claim 9, wherein each of the fluid actuators comprises a thermal resistive-based fluid actuator.

13. The fluid ejection system of claim 9 further comprising a second fluidic die.

14. The fluid ejection system of claim 9 further comprising a fluid reservoir to supply fluid for displacement by the fluid actuators.

15. The fluid ejection system of claim 9 further comprising a controller to control actuation of the fluid actuators.

16. The fluid ejection system of claim 9 further firing chambers formed in the substrate and having orifices, wherein each of the fluid actuator is located to selectively eject fluid within a respective one of the firing chambers through a respective one of the orifices.

17. A method comprising:

providing electrical power having a regulated predetermined voltage with a voltage regulator;

generating a switch drive voltage using the electrical power having the regulated predetermined voltage and based upon control signals to bias a low side switch transistor connected between an electrical resistor of a fluid actuator and a ground node for low side switch gate control, wherein the predetermined voltage is greater than a voltage of the control signals;

transmitting electrical power from a power node across the electrical resistor of the fluid actuator to displace fluid; and generating a second switch drive voltage using the electrical power from the power node and based upon second control signals to bias a second transistor electrically connected between the electrical resistor of the fluid actuator and the power node.

18. The method of claim 17, wherein the voltage of the control signals is less than or equal to 6 V.

19. The method of claim 17, wherein the regulated predetermined voltage of the power output by the voltage regulator is to remain constant independent of a number of the fluid actuators being actuated at any time.

20. The method of claim 17, wherein the fluid actuator comprises a thermal resistive-based fluid actuator.

* * * * *